US010058184B1

(12) United States Patent
Philemon

(10) Patent No.: US 10,058,184 B1
(45) Date of Patent: Aug. 28, 2018

(54) BACK SUPPORT SYSTEM

(71) Applicant: Jacob Philemon, Grand Prairie, TX (US)

(72) Inventor: Jacob Philemon, Grand Prairie, TX (US)

( * ) Notice: Subject to any disclaimer, the term of this patent is extended or adjusted under 35 U.S.C. 154(b) by 238 days.

(21) Appl. No.: 15/265,961

(22) Filed: Sep. 15, 2016

Related U.S. Application Data

(60) Provisional application No. 62/218,636, filed on Sep. 15, 2015.

(51) Int. Cl.
*A47C 7/42* (2006.01)
*A47C 7/38* (2006.01)
*A47C 7/46* (2006.01)

(52) U.S. Cl.
CPC ..... *A47C 7/425* (2013.01); *A47C 7/38* (2013.01); *A47C 7/46* (2013.01)

(58) Field of Classification Search
CPC ..... A47C 7/425; A47C 7/46
See application file for complete search history.

(56) References Cited

U.S. PATENT DOCUMENTS 2,756,808 A * 7/1956 Eichorst ..... B60N 2/882 297/230.11
4,108,492 A * 8/1978 Kirby ..... A47C 7/021 297/284.3
4,189,182 A * 2/1980 Rhoe ..... A47C 7/425 297/452.32
4,362,334 A * 12/1982 Ross ..... A47C 7/405 297/230.12
4,572,578 A * 2/1986 Perkins ..... A47C 7/46 297/452.32
4,718,724 A * 1/1988 Quinton ..... A47C 7/46 297/230.14
4,787,106 A * 11/1988 Paxon ..... A47C 7/425 297/452.3
4,810,034 A * 3/1989 Beier ..... A47C 7/425 297/230.14
4,835,801 A * 6/1989 Walpin ..... A47C 7/425 297/452.32

(Continued)

*Primary Examiner* — David R Dunn
*Assistant Examiner* — Tania Abraham
(74) *Attorney, Agent, or Firm* — Eldredge Law Firm, LLC; Richard Eldredge

(57) ABSTRACT

A chair back support cushioning system includes a cushioned body forming an inner cavity configured to rest on a back of a chair and secure thereto via a strap; an upper horizontal head support having a cylindrical body and composed of a semi-rigid material; a lateral support having a cylindrical body and forming a U-shape around an inner area; a first horizontal support having a cylindrical body and positioned within the inner area of the lateral support; a second horizontal support having a cylindrical body and positioned within the inner area of the lateral support, the second horizontal support being spaced apart from the first horizontal support; a first lateral outward notch configured to peripherally surround the lateral support and adapted to secure the lateral support to the head support; a second lateral outward notch configured to peripherally surround the first horizontal support; and a third lateral outward notch configured to peripherally surround the second horizontal support.

1 Claim, 3 Drawing Sheets

(56) References Cited

U.S. PATENT DOCUMENTS 4,876,755 A * 10/1989 Parrish ..... A47C 7/425 297/230.1
5,054,854 A * 10/1991 Pruit ..... A47C 7/383 297/284.3
5,101,811 A * 4/1992 Brunswick ..... A47C 7/425 297/112
5,251,957 A * 10/1993 Lemens ..... A47C 7/425 297/230.1
5,452,940 A * 9/1995 Maier ..... A47C 7/022 297/452.27
5,501,508 A * 3/1996 Llewellyn ..... A47C 7/383 297/227
5,702,153 A * 12/1997 Pliska ..... A47C 7/022 297/230.1
5,785,669 A * 7/1998 Proctor ..... A47C 7/425 297/284.6
6,083,435 A * 7/2000 Albecker, III ..... A47C 7/021 264/259
7,540,564 B2 * 6/2009 Gokhale ..... A47C 7/425 297/230.14
7,758,119 B1 * 7/2010 Baterdouk ..... A47C 7/72 297/217.6
7,887,131 B2 * 2/2011 Chadwick ..... A47C 1/03255 297/284.4
8,261,386 B2 * 9/2012 Kardos ..... A47C 7/425 297/452.32
2003/0115658 A1 * 6/2003 Stewart, III ..... A47C 7/425 2/94
2008/0164734 A1 * 7/2008 Nile ..... A47C 7/425 297/230.13
2010/0289305 A1 * 11/2010 Chen ..... A47C 7/425 297/230.13
2012/0098310 A1 * 4/2012 Bryer ..... A47C 7/021 297/284.4
2013/0226053 A1 * 8/2013 Khan ..... A47C 7/021 601/134
2014/0300157 A1 * 10/2014 Halliday ..... A47C 7/46 297/284.3
2015/0151658 A1 * 6/2015 Burris ..... A47C 7/021 297/220

* cited by examiner

BACK SUPPORT SYSTEM

BACKGROUND

1. Field of the Invention

The present invention relates generally to back support systems, and more specifically, to a back support system with multiple sections for relieving pressure and stress in the muscle-skeletal system.

2. Description of Related Art

Back support systems are well known in the art and are effective means to improve user posture and comfort. For example, FIG. 1 depicts a conventional back support system 101 having a chair 102 in communication with a back support cushion 103. During use, the user (not shown) sits in the chair 102 and the back support cushion 103 relieves pressure on the lumbar (lower back) region of the user's spine.

One of the problems commonly associated with system 101 is its limited support. For example, system 101 only provides support to one area of the back, the lumbar region.

It should be understood that the spine is generally divided into four regions: the cervical region at the base of the skull; the scapula-thoracic region at the shoulders and upper back; the lumbar region at the lower back; and the sacral region at the base.

Accordingly, although great strides have been made in the area of back support systems, many shortcomings remain.

DESCRIPTION OF THE DRAWINGS

The novel features believed characteristic of the embodiments of the present application are set forth in the appended claims. However, the embodiments themselves, as well as a preferred mode of use, and further objectives and advantages thereof, will best be understood by reference to the following detailed description when read in conjunction with the accompanying drawings, wherein:

Figure 1:
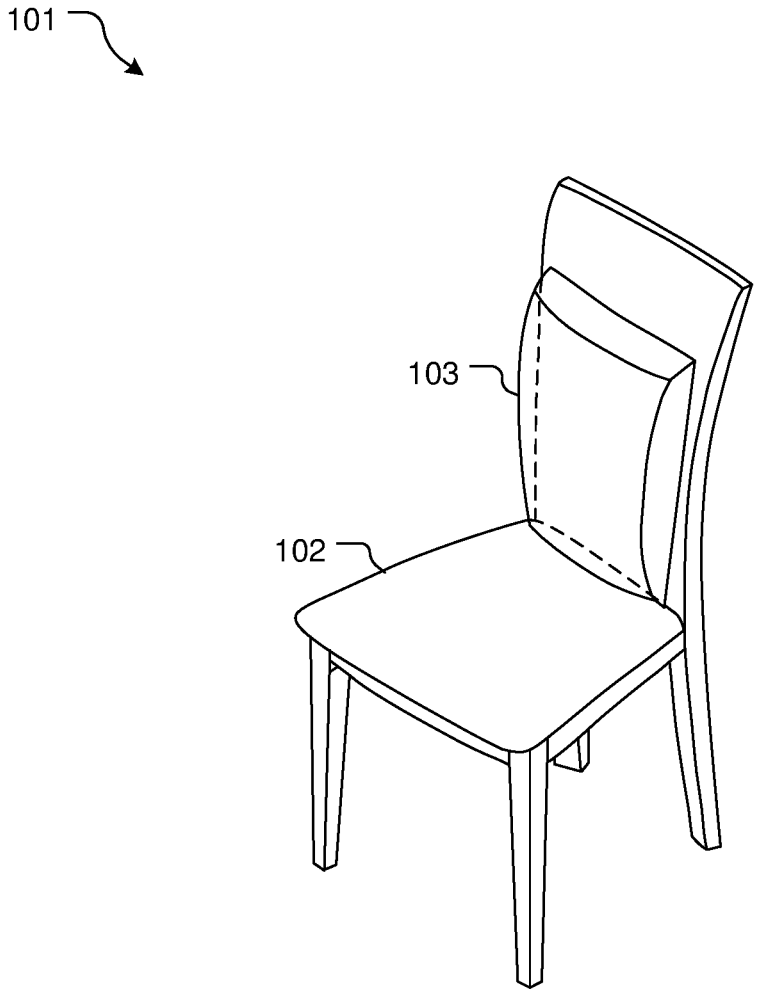
FIG. 1 (Prior Art)
FIG. 1 is an oblique view of a common back support system.

While the system and method of use of the present application is susceptible to various modifications and alternative forms, specific embodiments thereof have been shown by way of example in the drawings and are herein described in detail. It should be understood, however, that the description herein of specific embodiments is not intended to limit the invention to the particular embodiment disclosed, but on the contrary, the intention is to cover all modifications, equivalents, and alternatives falling within the spirit and scope of the present application as defined by the appended claims.

DETAILED DESCRIPTION OF THE PREFERRED EMBODIMENT

Illustrative embodiments of the system and method of use of the present application are provided below. It will of course be appreciated that in the development of any actual embodiment, numerous implementation-specific decisions will be made to achieve the developer's specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

The system and method of use in accordance with the present application overcomes one or more of the above-discussed problems commonly associated with conventional back support systems. Specifically, the present invention provides support to multiple areas of the user's spine. These and other unique features of the system and method of use are discussed below and illustrated in the accompanying drawings.

The system and method of use will be understood, both as to its structure and operation, from the accompanying drawings, taken in conjunction with the accompanying description. Several embodiments of the system are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless described otherwise.

The preferred embodiment herein described is not intended to be exhaustive or to limit the invention to the precise form disclosed. It is chosen and described to explain the principles of the invention and its application and practical use to enable others skilled in the art to follow its teachings.

Figure 2:
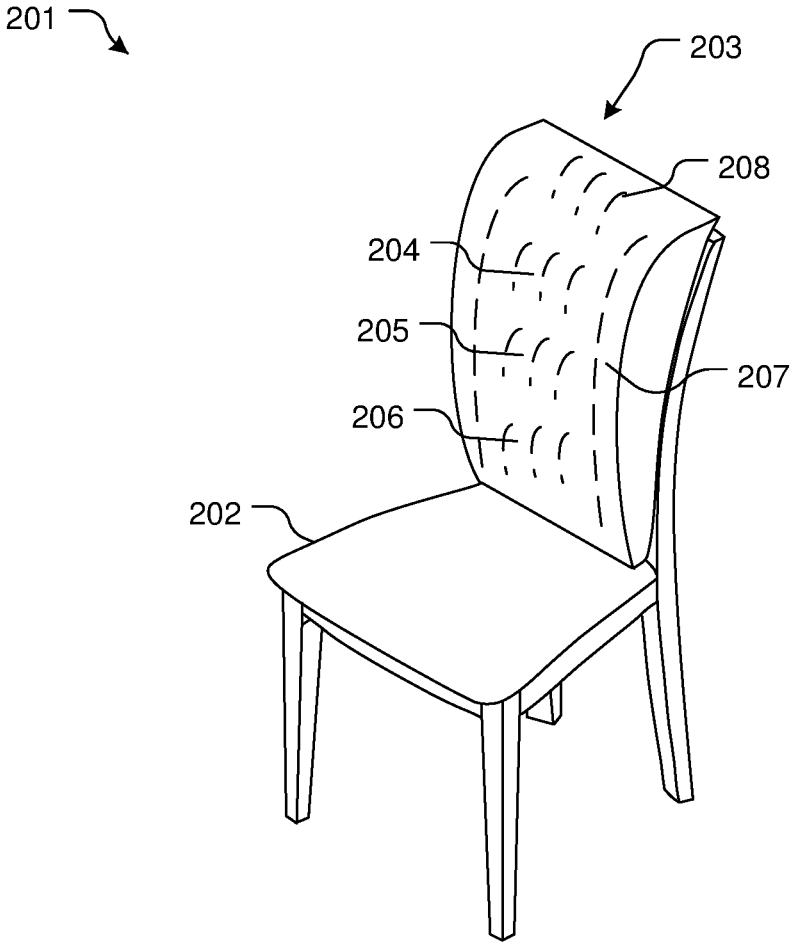
FIG. 2 is an oblique view of a back support system in accordance with a preferred embodiment of the present application.

Referring now to the drawings wherein like reference characters identify corresponding or similar elements throughout the several views, FIG. 2 depicts an oblique view of a back support system in accordance with a preferred embodiment of the present application. It will be appreciated that system 201 overcomes one or more of the above-listed problems commonly associated with conventional back support systems.

Figure 3:
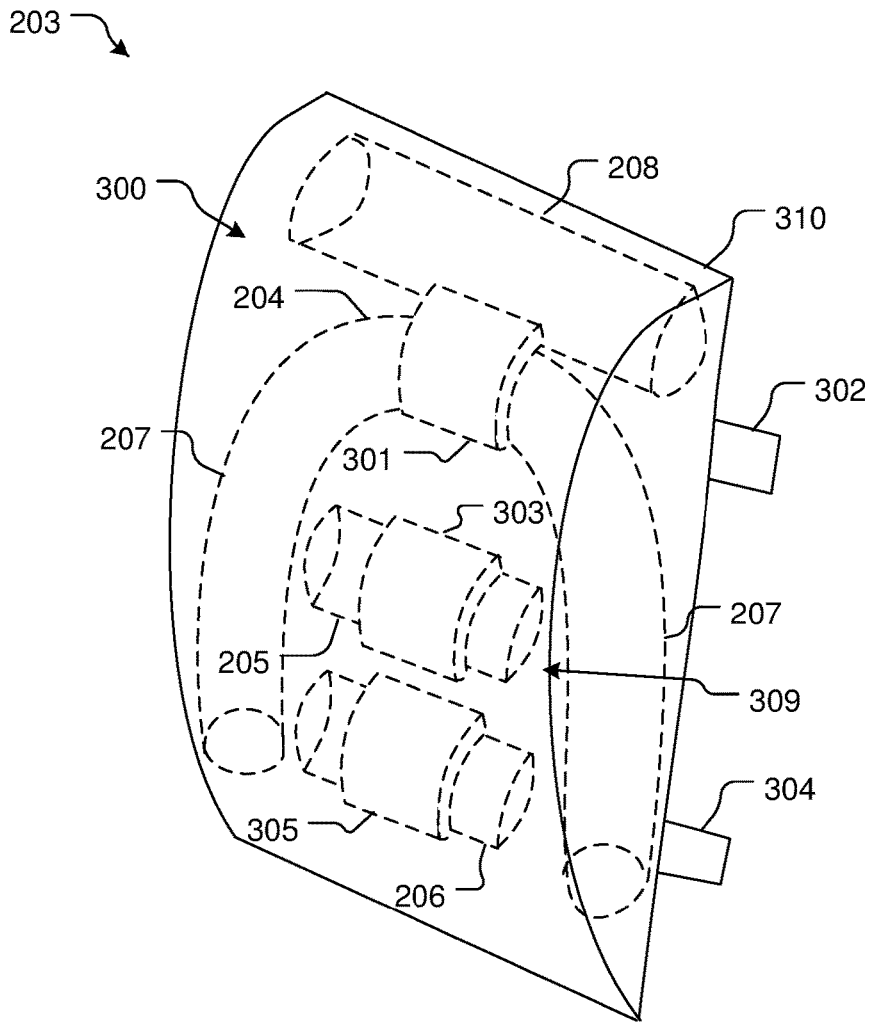
FIG. 3 is an oblique view of the back support from FIG. 2.

In the contemplated embodiment, system 201 includes a seat 202 in communication with a back support 203 comprising a scapula thoracic support region 204, a lumbar support region 205, and a sacral support region 206. It is contemplated that the back support 203 can further comprise lateral musculoskeletal supports 207 and a head support 208. During use, the user (not shown) sits in the seat 202 and the back support 203 provides support to multiple areas of the user's spine As shown in FIG. 3, the system includes a body 310 that forms an inner cavity 300 wherein the supports discussed herein are disposed within the inner cavity 300. In the contemplated embodiment, the back support 203 comprises firm support regions 204, 205, 206 for the scapula thoracic region, the lumbar region, and the sacral region, respectively, of the user's spine. In addition, it is contemplated that the back support 203 can further comprise firm lateral musculoskeletal supports 207 in communication with the scapula thoracic support 204 and a semi-firm head support 208. It is contemplated that the back support 203 can be covered in any flexible material and the gaps between each support region can be filled with a semi-rigid or firm material. It will also be appreciated that the back support 203 also include one or more straps 302, 304 extending from the body and configured to engage with the seat, more specifically, in one contemplated embodiment, the straps 302, 304 are configured to wrap around the periphery of the seats. In the preferred embodiment, the supports 205, 206, 207, and 108 are cylindrical in shape and are composed of a semi-rigid material for apply pressure against different locations on the user's back. As depicted, the horizontal supports 205, 206 are positioned within an inner area 309 formed by the U-shaped support 207.

It should be appreciated that one of the unique features believed characteristic of the present application is the improved spinal alignment of the user due to the multiple center support regions 204, 205, 206 of the back support 203. It is understood that this feature can relieve stress and pressure along multiple regions of the user's spine. In addition, the outward notches 301, 303, and 305 provide tactile feedback to help train the user's spine and improve posture. In the preferred embodiment, the outward notices extend around the outer periphery of the support members secured thereto. Further, lateral musculoskeletal supports 207 and semi-firm head support 208 can provide additional user comfort. The notch 301 is secured to both supports 207 and 208 to provide additions support and rigidity, and selectively located to come into contact with the neck of the user.

Alternative embodiments contemplate the addition of straps with buckles, latches, or other fasteners to the back support 203 for securement to a seat. It is also contemplated that the back support 203 may vary in size, material, and style as aesthetic, functional, or manufacturing considerations require and further alternative embodiments contemplate that the back support 203 can be permanently manufactured into a seat.

The particular embodiments disclosed above are illustrative only, as the embodiments may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. Although the present embodiments are shown above, they are not limited to just these embodiments, but are amenable to various changes and modifications without departing from the spirit thereof.

What is claimed is:

1. A chair back support cushioning system, comprising:

a cushioned body forming an inner cavity configured to rest on a back of a chair and secure thereto via a strap;

an upper horizontal head support having a cylindrical body and composed of a semi-rigid material;

a lateral support having a cylindrical body and forming a U-shape around an inner area;

a first horizontal support having a cylindrical body and positioned within the inner area of the lateral support;

a second horizontal support having a cylindrical body and positioned within the inner area of the lateral support, the second horizontal support being spaced apart from the first horizontal support;

a first lateral outward notch configured to peripherally surround the lateral support and adapted to secure the lateral support to the head support;

a second lateral outward notch configured to peripherally surround the first horizontal support; and a third lateral outward notch configured to peripherally surround the second horizontal support;

wherein the first lateral outward notch, the second lateral outward notch, the third lateral outward notch are laterally aligned with each other; and wherein the upper horizontal head support, the lateral support, the first horizontal support, the second horizontal support, the first lateral outward notch, the second lateral outward notch, and the third lateral outward notch are disposed within the inner cavity formed by the cushioned body.

* * * * *